US009414719B2

(12) United States Patent
Gay et al.

(10) Patent No.: US 9,414,719 B2
(45) Date of Patent: Aug. 16, 2016

(54) CORNER SUPPORT PLATFORM

(71) Applicant: 2M Products, LLC, Loveland, CO (US)

(72) Inventors: Michael Lee Gay, Loveland, CO (US); Michelle Ann Echelberger, Loveland, CO (US)

(73) Assignee: 2M PRODUCTS, LLC, Loveland, CO (US)

( * ) Notice: Subject to any disclaimer, the term of this patent is extended or adjusted under 35 U.S.C. 154(b) by 123 days.

(21) Appl. No.: 14/065,917

(22) Filed: Oct. 29, 2013

(65) Prior Publication Data

US 2014/0115774 A1 May 1, 2014

Related U.S. Application Data

(60) Provisional application No. 61/720,053, filed on Oct. 30, 2012.

(51) Int. Cl.

| | |
|---|---|
| ***A47K 3/00*** | (2006.01) |
| ***A47K 3/28*** | (2006.01) |
| *A47K 3/12* | (2006.01) |

(52) U.S. Cl.
CPC *A47K 3/281* (2013.01); *A47K 3/125* (2013.01)

(58) Field of Classification Search
CPC ..... A47K 3/281; A47K 3/125
USPC ..... 4/611, 571.1, 574.1, 578.1, 579, 594; D23/304; 297/423.1–423.46
See application file for complete search history.

(56) References Cited

U.S. PATENT DOCUMENTS

| | | | | |
|---|---|---|---|---|
| 1,019,775 | A | | 3/1912 | Forsberg |
| 1,232,223 | A | | 7/1917 | Clarke |
| 1,265,609 | A | | 5/1918 | Carry |
| 2,127,762 | A | * | 8/1938 | Bentz ..... 4/579 |
| 2,818,577 | A | * | 1/1958 | Kubik et al. ..... 4/611 |
| D190,624 | S | | 6/1961 | Morrison et al. |
| 3,275,283 | A | | 9/1966 | Rauch |
| 3,396,413 | A | | 8/1968 | Kaufman |
| 3,713,180 | A | | 1/1973 | Martin |
| 4,356,575 | A | | 11/1982 | Terry |
| 4,489,448 | A | | 12/1984 | Cairo |
| 4,493,712 | A | | 1/1985 | Kampff |
| D287,075 | S | | 12/1986 | Colin et al. |
| D289,840 | S | | 5/1987 | Burkes |
| 4,994,648 | A | | 2/1991 | Gil |
| 5,224,224 | A | | 7/1993 | Hintz et al. |
| 5,228,151 | A | | 7/1993 | Livingston-Capoano |
| D340,508 | S | | 10/1993 | Hocker |
| 5,331,693 | A | | 7/1994 | Peterson et al. |
| 5,337,525 | A | | 8/1994 | Zaccai et al. |
| 5,340,070 | A | | 8/1994 | Soma |
| 5,341,528 | A | | 8/1994 | Sultzbaugh |
| D351,647 | S | | 10/1994 | Sultzbaugh |
| 5,425,149 | A | | 6/1995 | Crossley et al. |

(Continued)

*Primary Examiner* — Huyen Le
*Assistant Examiner* — Christine Skubinna
(74) *Attorney, Agent, or Firm* — Dorsey & Whitney LLP

(57) ABSTRACT

This invention relates to home furnishings and accessories that utilize corner space of a shower stall as a support platform. The support platform may include a top support surface with two sides positioned to contact two perpendicular walls of the corner. A support frame may connect to the top support surface such that the bottom of the support frame and the top support surface are offset from one another. This offset configuration of the support platform may prevent the support frame from interfering with anything in the area directly below the top support surface.

14 Claims, 12 Drawing Sheets

(56) References Cited

U.S. PATENT DOCUMENTS

| | | | | |
|---|---|---|---|---|
| 5,465,435 | A | | 11/1995 | Malvaez et al. |
| 5,579,545 | A | | 12/1996 | Beard |
| 5,647,072 | A | | 7/1997 | Shaffer et al. |
| 5,732,421 | A | | 3/1998 | Scherberger |
| D400,382 | S | | 11/1998 | Wendt |
| D404,475 | S | * | 1/1999 | Livingston-Capoano ... D23/304 |
| 5,920,926 | A | | 7/1999 | Torres |
| 6,029,291 | A | | 2/2000 | Livingston-Capoano |
| D422,687 | S | | 4/2000 | Livingston-Capoano |
| 6,065,251 | A | * | 5/2000 | Kindrick ..... 52/36.4 |
| 6,094,756 | A | | 8/2000 | Carter |
| 6,115,857 | A | | 9/2000 | Bidegain |
| 6,301,725 | B1 | | 10/2001 | Harvey |
| 6,532,969 | B2 | | 3/2003 | Nuzzo |
| D487,533 | S | | 3/2004 | Abbott et al. |
| 6,848,368 | B2 | * | 2/2005 | Leith ..... 108/42 |
| 7,266,851 | B1 | | 9/2007 | Batalini |
| 7,310,837 | B2 | | 12/2007 | Reynolds et al. |
| 7,886,376 | B2 | | 2/2011 | Ray |
| 7,950,078 | B2 | | 5/2011 | Houpt |
| 7,987,535 | B1 | | 8/2011 | Tesch |
| 8,161,700 | B2 | | 4/2012 | Scalise |
| 8,225,435 | B2 | | 7/2012 | Kik, Jr. et al. |
| 8,628,143 | B2 | * | 1/2014 | Wald ..... 297/423.39 |
| 2006/0036198 | A1 | | 2/2006 | Cafaro et al. |
| 2006/0143820 | A1 | | 7/2006 | Matthews |
| 2006/0207010 | A1 | | 9/2006 | DeBoer et al. |
| 2007/0163039 | A1 | | 7/2007 | Lee et al. |
| 2009/0183305 | A1 | | 7/2009 | Sampaio |
| 2009/0189432 | A1 | | 7/2009 | Anikin |
| 2011/0018327 | A1 | | 1/2011 | Abolkheir |
| 2011/0252561 | A1 | * | 10/2011 | Garrels et al. ..... 4/611 |
| 2011/0308007 | A1 | | 12/2011 | Stevens |

* cited by examiner

CORNER SUPPORT PLATFORM

PRIORITY CLAIM

This application is a non-provisional of and claims the benefit of priority to U.S. Provisional Patent Application No. 61/720,053 entitled "LEG SUPPORT FOR USE IN A SHOWER," filed on filed Oct. 30, 2012, which is hereby incorporated by reference in its entirety.

TECHNICAL FIELD

This invention relates to home furnishings and accessories.

BACKGROUND

At various times there is a need for a support platform that can be located in the corner of a room. A glaring example of this is in a shower stall. Women generally shave their legs in the shower and as such require some form of support for the elevated leg being shaved. However, shower stalls lack adequate provisions to aid in this task. Shower stalls also tend to have very little space so there is typically inadequate room to address this issue with typical furniture, step stools and the like. Similar problems within the shower stall extend to other areas of the home where a support platform can be used. For example, walls in a home typically have some sort of protrusion near the floor. This protrusion, commonly in the form of a base board, frequently interferes with furniture that is meant to contact the wall. A specific example of this is in a shower stall. In many showers the basin and the wall are not in the same plane. Instead a portion of the basin or something similar protrudes from the wall at the base. As such, it is difficult to keep a step or platform in a shower stall, which is already small, without taking up unnecessary space by having the step/platform unnecessarily far from the wall or with unnecessarily bulky supports holding the step/platform off the floor. One consequence is that typical shower stalls have no suitable place to support one's legs for shaving and that makes shaving legs difficult.

It is therefore desirable to provide an improved support surface for use in the various corners of homes such as in the shower, and in particular a support surface, which addresses the above described problems and/or which more generally offers improvements or an alternative to existing corner support surfaces.

SUMMARY

As variously discussed herein, there is provided a corner support device as defined in the accompanying claims. In accordance with various embodiments, a corner step may comprise a top support surface, a first contact surface, a second contact surface, and connecting walls. The first contact surface may be connected to the top support surface and configured to be parallel to or contact a first wall. The second contact surface may be connected to the top support surface and the first contact surface and may be configured to be parallel to or contact a second wall which is perpendicular to the first wall. The connecting walls may be connected to the top support surface, the first contact surface, and the second contact surface. One or more of the connecting walls may angle away from the top support surface such that the connecting walls do not contact the first wall or second wall while the first contact surface and the second contact surface are in contact with the first wall or the second wall respectively.

In accordance with various embodiments, a corner support platform may comprise a top support surface having two sides which are positioned to contact two perpendicular walls which are each perpendicular to the floor. The corner support platform may also comprise a support frame which connects to the top support surface such that the bottom of the support frame and the top support surface are not aligned but are offset from one another. This orientation may be such that the area directly below the top support surface is not occupied by the bottom of the support frame.

A leg support for use in the shower comprises a base module mechanically coupled to a support frame which includes the top supporting surface. The assembly can be supported against two adjacent perpendicular corner walls and floor of a shower and provides sufficient support for a user's leg upon the top portion.

This summary of the disclosure is given to aid understanding, and one of skill in the art will understand that each of the various aspects and features of the disclosure may advantageously be used separately in some instances, or in combination with other aspects and features of the disclosure in other instances.

BRIEF DESCRIPTION OF THE DRAWINGS

The present invention will now be described by way of example only with reference to the following figures in which.

DETAILED DESCRIPTION

This invention relates to home furnishings and accessories that utilize corner space of a shower stall as a support platform. The support platform may include a top support surface with two sides positioned to contact two perpendicular walls of the corner. A support frame may connect to the top support surface such that the bottom of the support frame and the top support surface are offset from one another. This offset configuration of the support platform may prevent the support frame for interfering with anything in the area directly below the top support surface.

Figure 1:
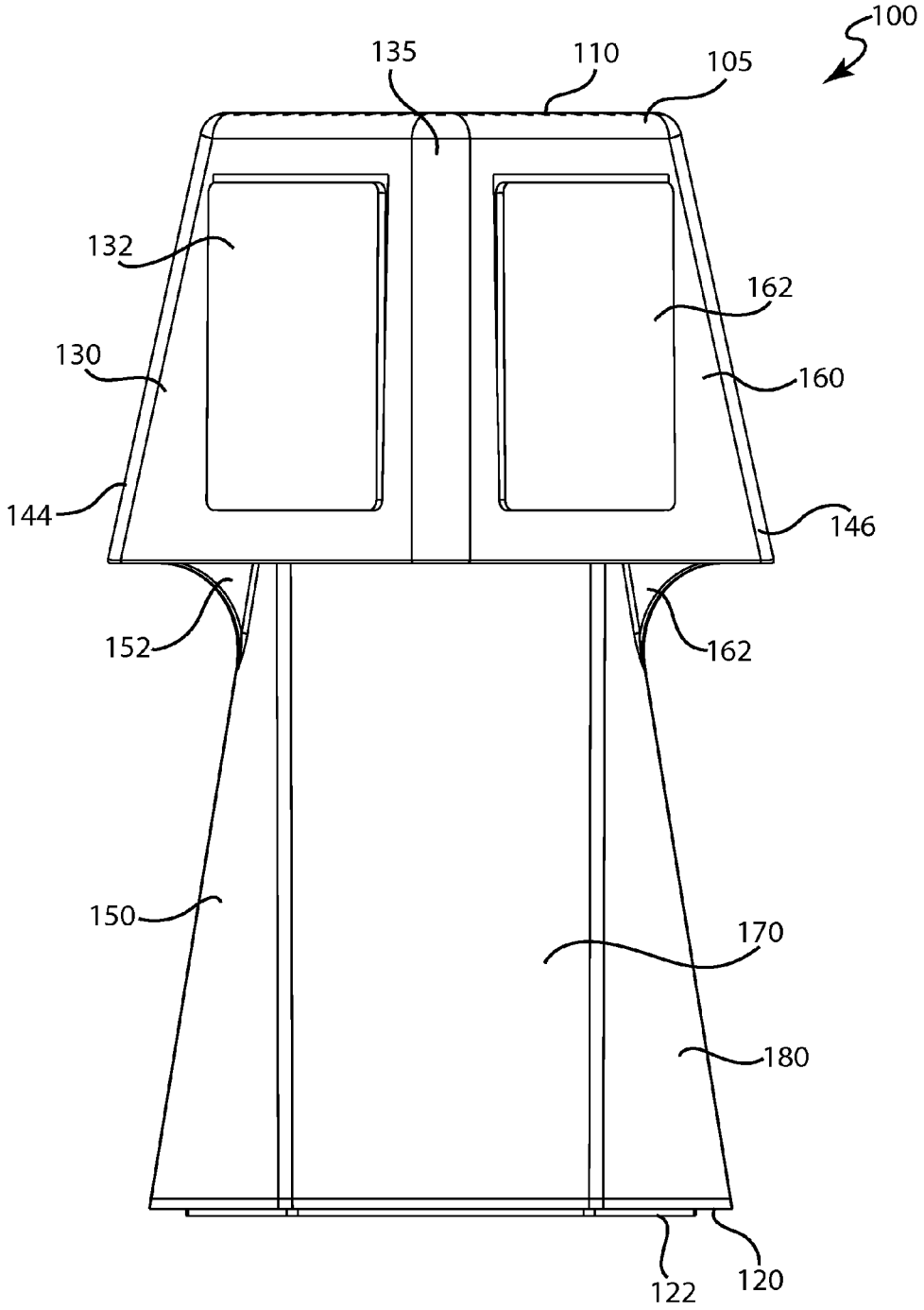
FIG. 1 is a back view of a support surface.

In accordance with various embodiments, as illustrated in FIG. 1, a corner support structure 100 may include a top support surface 110. The top support surface 110 may be operable to support an item on its upper surface. The top surface 110 may be smooth or textured to provide for additional traction. For example, the top surface 110 may include texture grooves 112. (Also shown in FIG. 3) The texture grooves 112 may be contours in the surface. The contours may be included at the time of manufacture such as in a plastic injection molding tool. Alternatively the texture grooves may be machined into the surface after manufacture of the corner support structure 100. The surface may also be textured by applying a textured coating to the surface after manufacture of corner support structure 100. The corner support structure 100 may further include a contact surface 130 and a contact surface 160. The top support surface 110 and the contact surfaces 130/160 may be connected. The connection may be at transition 105. Transition 105 may be any variety of connection between surfaces residing in different planes. For example, transition 105 may be a round, flat, or line connection between top support surface 110 and contact surfaces 130/160.

In accordance with various embodiments, the contact surface 130 and the contact surface 160 may be perpendicular to one another. However, in other embodiments, the contact surface 130 and the contact surface 160 may reside at angles to one another that reflect an angle between two walls for which the corner support structure is used. The contact surface 130 and the contact surface 160 may intersect at a transition 135. In various embodiments, transition 135 may be a round transition from contact surface 130 to contact surface 160. In other embodiments, transition 135 may be a flat transition from contact surface 130 to contact surface 160, forming another wall. Such a flat transition may avoid interfering with the profile of the intersection corner between two walls for which the corner support structure is used. As discussed in more detail below, contact surfaces 130 and 160 may further include traction pads 132/162 adhered to their surface.

Figure 2:
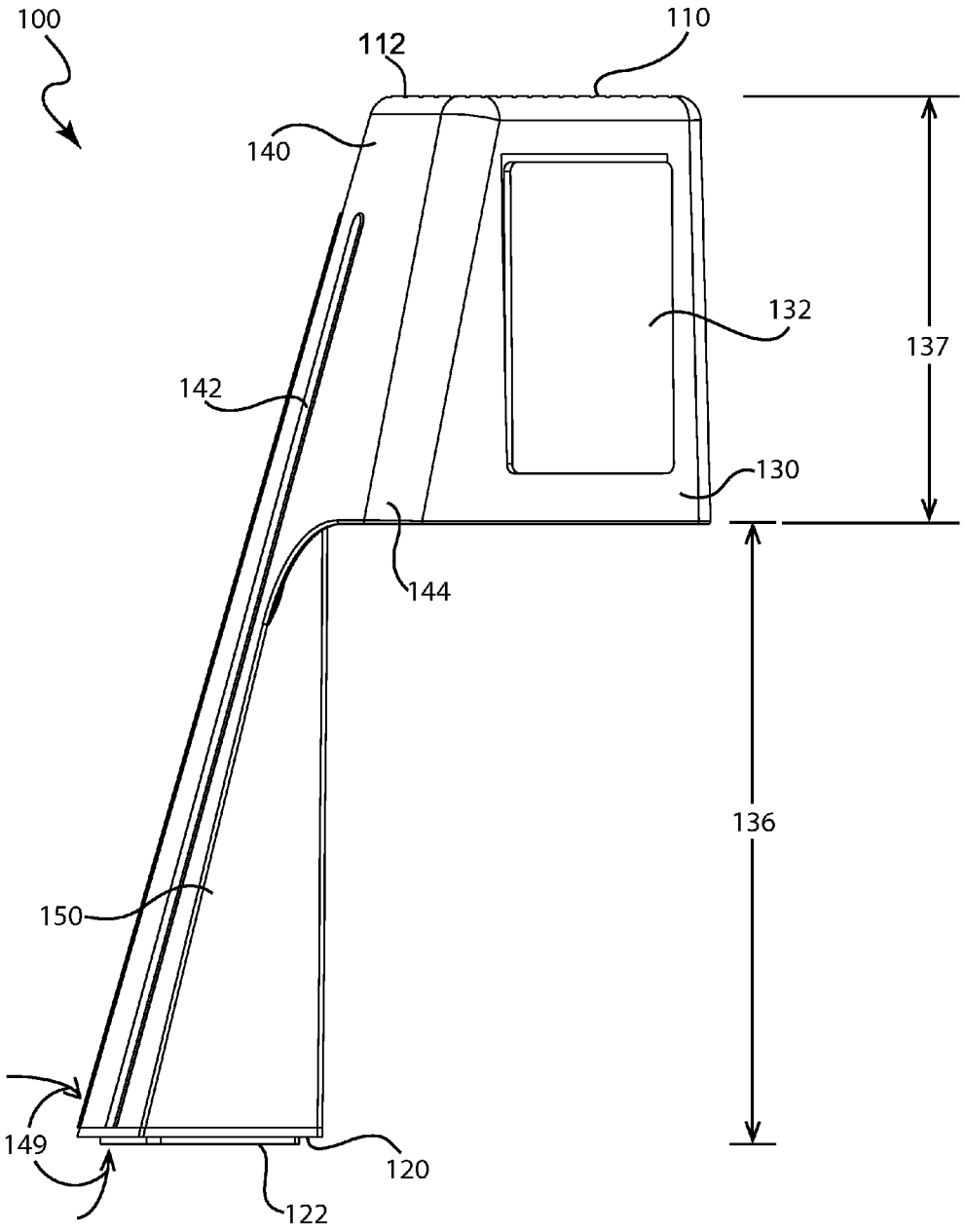
FIG. 2 is a right side view of a support surface.

Corner support structure 100 may also include one or more walls that extend from the bottom of the corner support structure 100 up top support surface 110. The one or more walls may include an interior wall 170. In one embodiment, interior wall 170 may be substantially vertical. This orientation may aid in manufacturing the corner support structure with a straight pull plastic injection molding process. In another embodiment, interior wall 170 may angle away from the top support surface 110. Alternatively, interior wall 170 may angle under the top support surface 110. In one example, the wall 170 may extend up from the bottom of corner support structure 100 to the top support surface 110. The one or more walls may further include side walls 150/180. Side walls may be connected at either side of the interior wall 170. As illustrated in FIG. 2, the one or more walls may further include an exterior wall 140. Exterior wall 140 may be connected to side walls 150/180. In accordance with various embodiments, the side walls 150/180, exterior wall 140 and interior wall 170 may form a support frame for top support surface 110, contact surface 160 and contact surface 130. At the bottom of this support frame, the bottom edges of the side walls 150/180, the exterior wall 140, and the interior wall 170 all end in the same plane (i.e. the bottom plane of the corner support structure 100) forming a structure that may contact a floor 20 flatly. In accordance with various embodiments, a base member 120 may be attached to the bottom edges of the walls.

Figure 3:
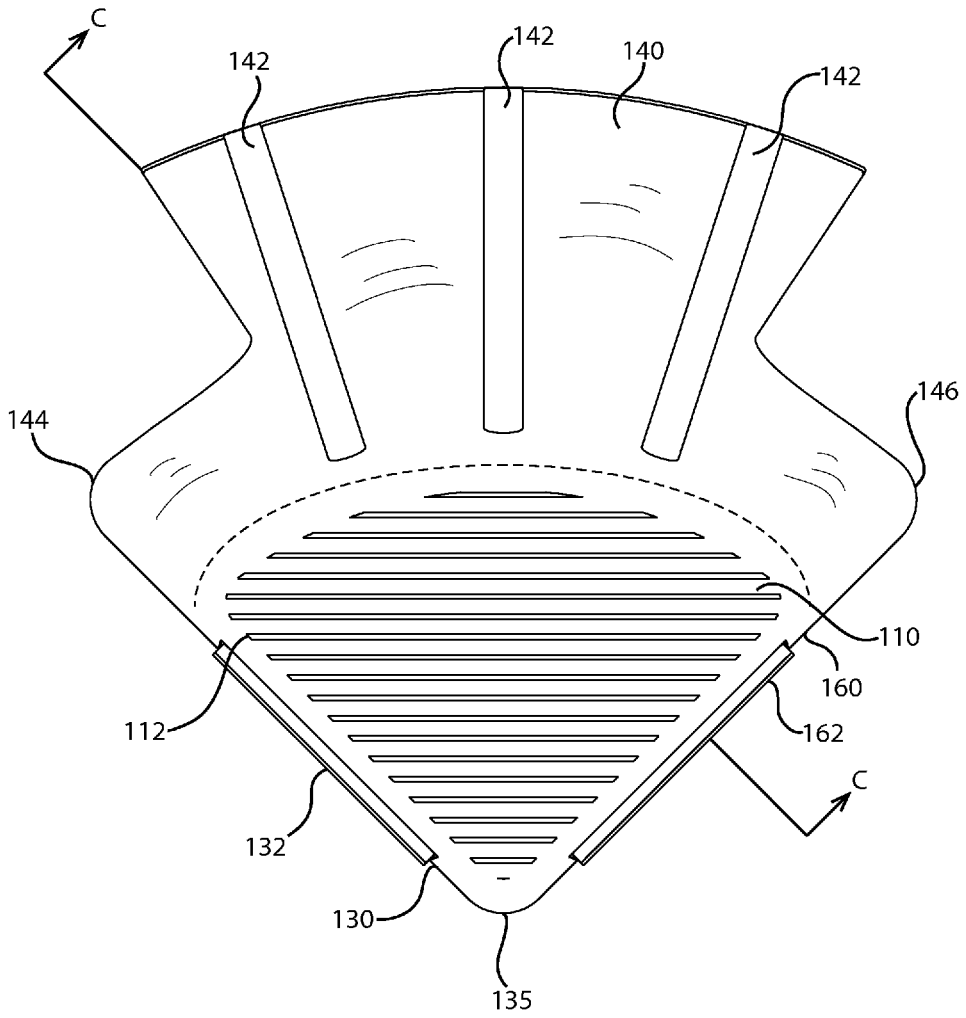
FIG. 3 is a top view of a support surface.

The support frame may have various reinforcing features. For example, as illustrated in FIGS. 2 and 3, exterior wall 140 may include ribs 142. The ribs 142 may extend along the height of exterior wall 140. While illustrated with respect to exterior wall 140, ribs may also reinforce the rest of the support frame such that support frame does not collapse under a force exerted on the top surface 110.

As illustrated in FIG. 2, the exterior wall 140 may reside at an angle 149 relative to the bottom plane of the corner support structure 100. The angle 149 may be from 30 degrees to 90 degrees. For example, in one embodiment, the angle may be 74 degrees. It may be noted that the angle may vary based on the height of the corner support structure 100, the area of the top support surface 110, and the area of the bottom of the corner support structure 100 takes up, such as the area of the base member 120. Variation in the angle 149 may be utilized to position the top support surface so that it is not directly above the bottom of the support frame and/or the base member 20. One of ordinary skill in the art may be able to calculate the angle in order to place the bottom of the support frame in the desired position relative to the top surface. In other embodiments, the top support surface 110 may be positioned partially over the bottom of the support frame/base member 20.

As illustrated in FIGS. 1-2, the contact surfaces 130/160 may only extend to length 137, which may be a portion of the height of support structure 100. The contact surfaces 130/160 may begin at a length of 136 from the bottom of the support structure 100. By beginning at length 136, the contact surfaces may avoid interfering with any protrusions at the base of the wall that the contact surfaces 130/160 contact. For example, length 136 may be greater than the height of the rim or curb of the basin in a shower stall such as curb 40/50 illustrated in FIGS. 6-7. Length 136 may be 3-12 inches tall. More specifically length 136 may be about 7 inches tall. Length 136 and length 137 may be combined to be a suitable height for utilizing the corner support. For example, in a shower stall use, length 136 and 137 may be combined to be 8-18 inches. More specifically, length 136 and 137 may be combined to be about 13-14 inches tall.

As the contact 130/160 surfaces may not extend to the bottom of the support frame, elements of the support frame may flare out in order to connect to the contact surfaces. As such, the exterior wall 140 may have wings 152/162. The wings 152/162 include a portion of the exterior wall 140 near the top that attaches to contact surfaces. As illustrated in FIGS. 1-2 wings 152/162 may flare out from exterior wall 140 in order to connect the exterior wall 140 to the contact surfaces 130/160 respectively. The contact surface 130/160 and the exterior wall 140 may intersect at a transitions 144/146 respectively. In various embodiments, transitions 144/146 may be round transitions from contact surfaces 130/160 to exterior wall 140. In other embodiments, transitions 144/146 may be flat transitions.

Figure 4:
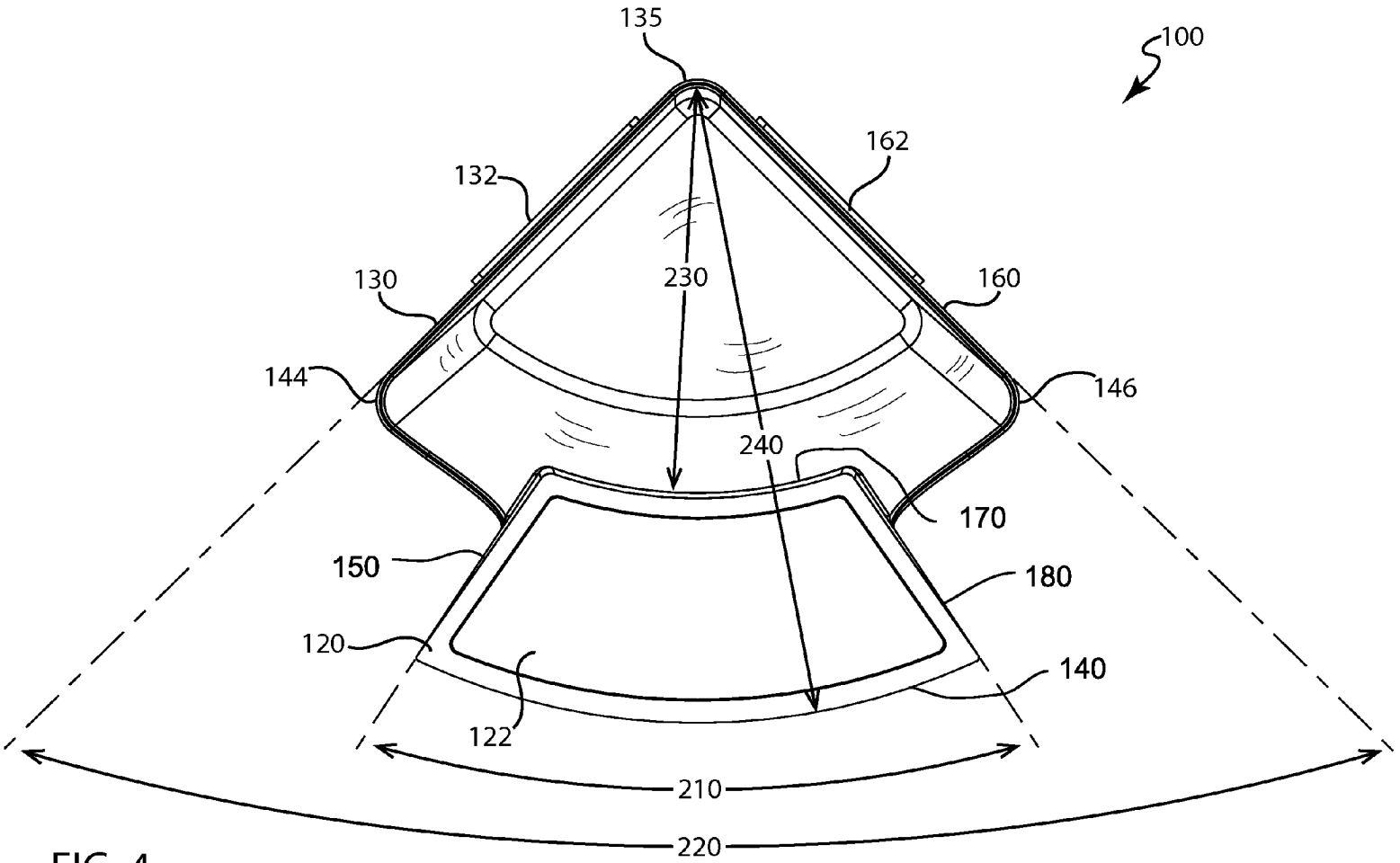
FIG. 4 is a bottom view of a support surface.
Figure 5:
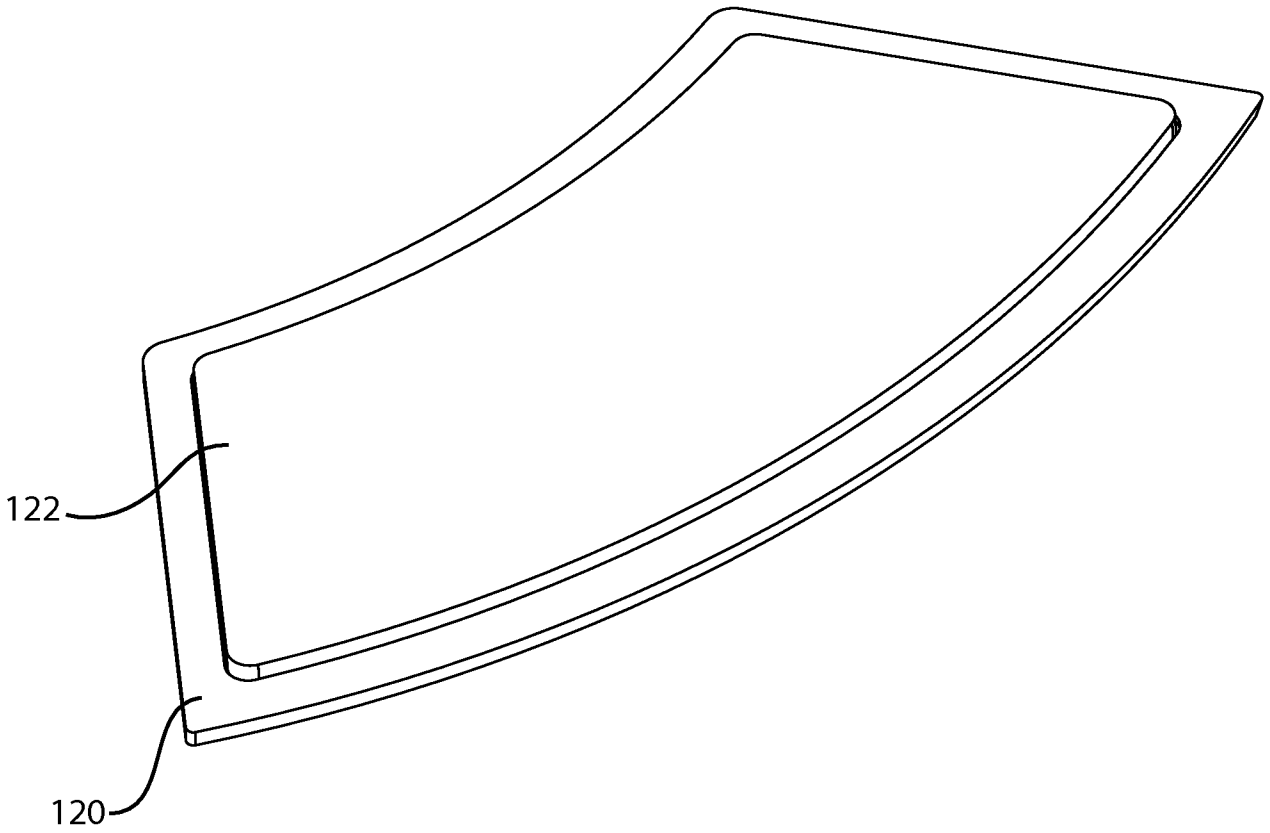
FIG. 5 is a top perspective view of a support base of a support surface.

FIG. 3 illustrates a top view of the corner support 112. As shown herein the texture grooves 112 (also discussed above) may extend across the top surface 100 providing increased friction/traction for anything that comes into contact with the surface. In accordance with various embodiments, as illustrated in FIG. 3, the exterior wall 140 may have a convex curvature extending away from top surface 110. Similarly illustrated in the bottom view of FIGS. 4 and 5, the corner support 100 may be formed in a shape that is a fraction of a circle. While the contact surfaces 130/140 may be perpendicular (or custom formed to the specific angle between two walls where the corner support 100 will be used) as indicated by angle 220, the shape of the structure between these two walls may form the arcs of a circle extending out (the corner support 100 may also be other shapes such as square, triangular, oval, or any unique and custom profile.) For example, from transition 135 out to interior wall 170 may be radius 230. From transition 135 out to exterior wall 140 may be radius 240. Radius 230 may be sufficient to clear any protrusion from the various walls adjacent to the corner support 100. Radius 240 may be sufficient to provide enough surface area to support the device and also enough surface area to provide sufficient traction from a traction pad to keep the corner support device 100 from sliding away from the walls. In various examples, radius 230 may be between 2 and 9 inches. More specifically, radius 230 may be between 5-6 inches. In various examples, radius 240 may be between 4 and 12 inches. More specifically, radius 240 may be between 8-9 inches. In one specific example, radius 230 may be about 5.5 inches and radius 240 may be about 8.3 inches.

In accordance with various embodiments, the angle 210 between side walls 150 and 180 may be less than the angle 220 between contact surfaces 130 and 160. By having the angle 210 between side walls 150 and 180 be less than the angle 220 between contact surfaces 130 and 160, the side walls may avoid interfering with any protrusions as the base of the shower stall. In one example, the angle 210 between side walls 150 and 180 may be from 10-80 degrees. More specifically, the angle 210 may be 40-60 degrees. In one specific example, the angle 210 may be 50 degrees.

By forming the corner support in a circular shape (or at least a portion of a circular shape) that floor area that the corner support 100 takes up is minimalized while the contact area of the corner support with the floor is maximized. This achieves a good balance between usefulness and taking up an efficient amount of space in the corner where the device is utilized.

Figure 6:
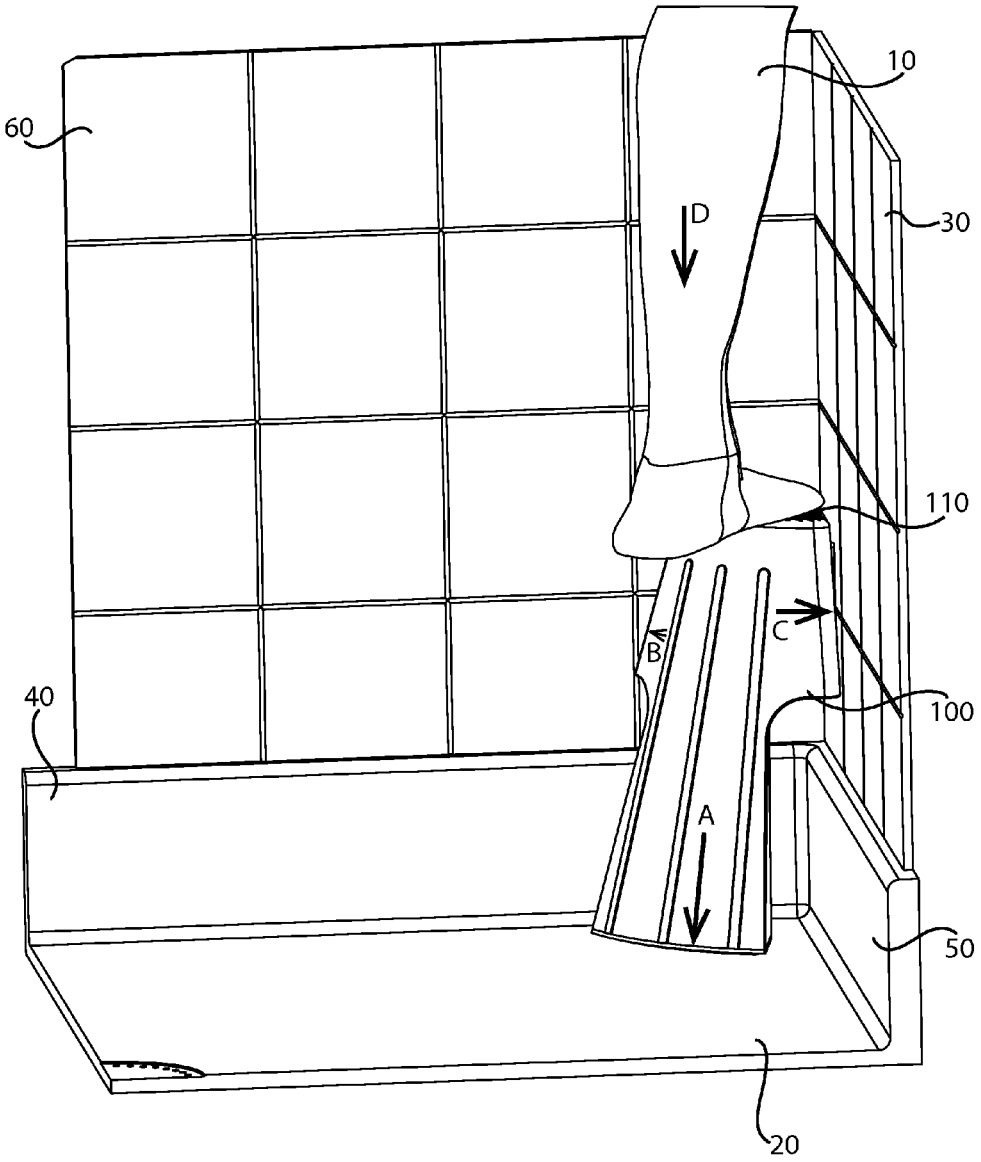
FIG. 6 is a front perspective view of a support surface used in a shower.

In accordance with various embodiments, as illustrated in FIG. 6 and alluded to above, a corner support structure 100 may be utilized in any situation in which two walls come together, such as wall 30 and wall 60. The corner support structure 100 may lean against the walls 30/60 near the location in which they meet. The corner support structure 100 may also be supported by a floor 20. At the top of the corner support structure 100, a support surface 110 may be suitably located to support an object on the top of the corner support structure 100. As illustrated in FIG. 6 the object may be a person's leg 10. It may be noted that the corner support structure 100 may be operable to support any object however as the figures utilize a shower stall as an example location for use of the corner support, the example object will be discussed herein with reference to a person's leg 10.

The person's leg 10 may create a downward force, illustrated by arrow D in FIG. 6, on the corner support structure 100. The resultant forces of the corner support structure 100 against the walls and floor are represented by arrows A, B, and C. Side surfaces of the corner support structure 100 are forced against the walls 30/60 along arrows B and C. A downward force drives the bottom of the corner support structure 100 against the floor. The downward force D is applied against the top support surface 110. However, according to various embodiments and further discussed herein, the top support surface may not be located directly above the bottom of the corner support structure 100 where the downward force A is located. Nonetheless, the geometry of the corner support structure 100 allows the unit to maintain its position without slipping.

Figure 7:
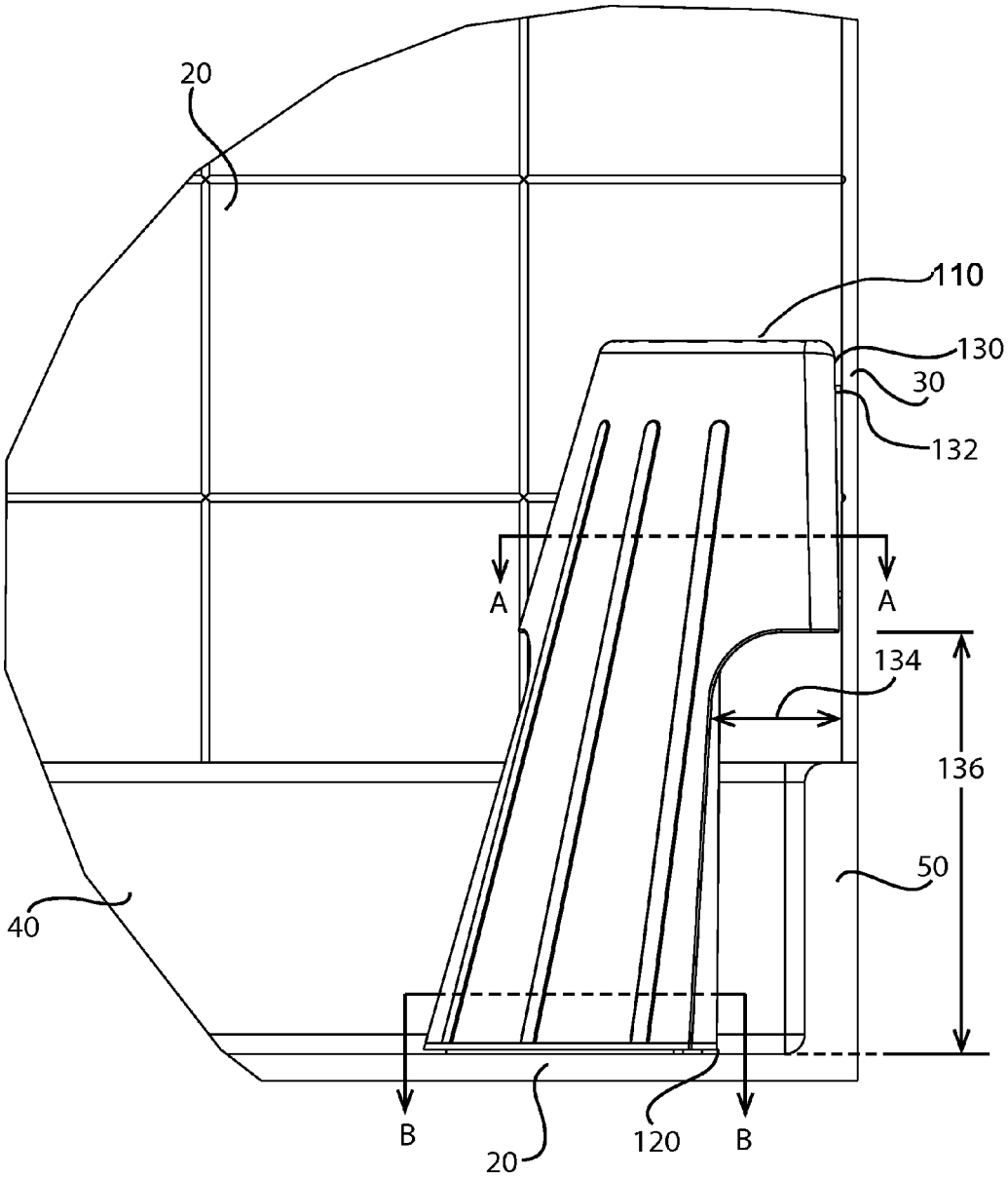
FIG. 7 is a front view of a shower stall with a support surface.

In accordance with various embodiments, as illustrated in FIG. 7, the corner support structure 100 may include a contact surface 130 located on the vertical side of the corner support structure 100. The contact surface 130 may be located such that it may contact the vertical wall 30. The contact surface 130 may connect with top support surface 110. In various embodiments, the support surface 110 and the contact surface 130 may be perpendicular. However, in other embodiments, top support surface 110 may not be perpendicular to contact surface 130 as it may be more or less than 90 degrees offset from the contact surface 130.

As shown in FIG. 7, the corner support structure 100 may further include a base element 120. Base element 120 may be positioned at the bottom of the corner support structure 100. In one embodiment, base element 120 may be in direct contact with the floor. In another embodiment, base element 120 may include traction pad 122, which may in turn be in direct contact with floor 20. In yet another embodiment, the bottom of corner support structure 100 may be in direct contact with the floor 20 or the bottom of the corner support structure 100 may include a traction pad.

In high friction environments, the contact surface, base member, or the corner support structure may be configured without a traction and contact the structural features of the environment directly, such as contact surface 130 directly against wall 30. However, in low friction environments, such as a shower stall, where water on hard surfaces makes slipping of the corner support structure 100 more likely, the contact surface, base member, or the corner support structure may include a traction pad, with the traction pad making direct contact with the environment support features such as traction pad 132 directly against wall 30.

In accordance with various embodiments, as illustrated in FIG. 7, a side wall of the corner support structure 100 is offset from the contact surface 130 according to relative position 134. This relative position 134 is greater than the typical structural features that protrude out from wall 30 such as a base board 50. Also shown in FIG. 7, the contact surface 130 may not extend all the way from the bottom of the support frame surface 130 to the floor 120. Instead, the end of the contact surface 130 may be offset from the bottom of the support frame as indicated by relative position 136. It may be noted that the relative positions 134 and 136 may be adjusted to any distance such that the bottom portion of the corner support 100 avoids contact with protrusions from walls 30/60 such as base boards 50/40 (e.g. the raised portion of a shower basin as specifically shown in 50/40 of FIGS. 6-7.

Figure 8:
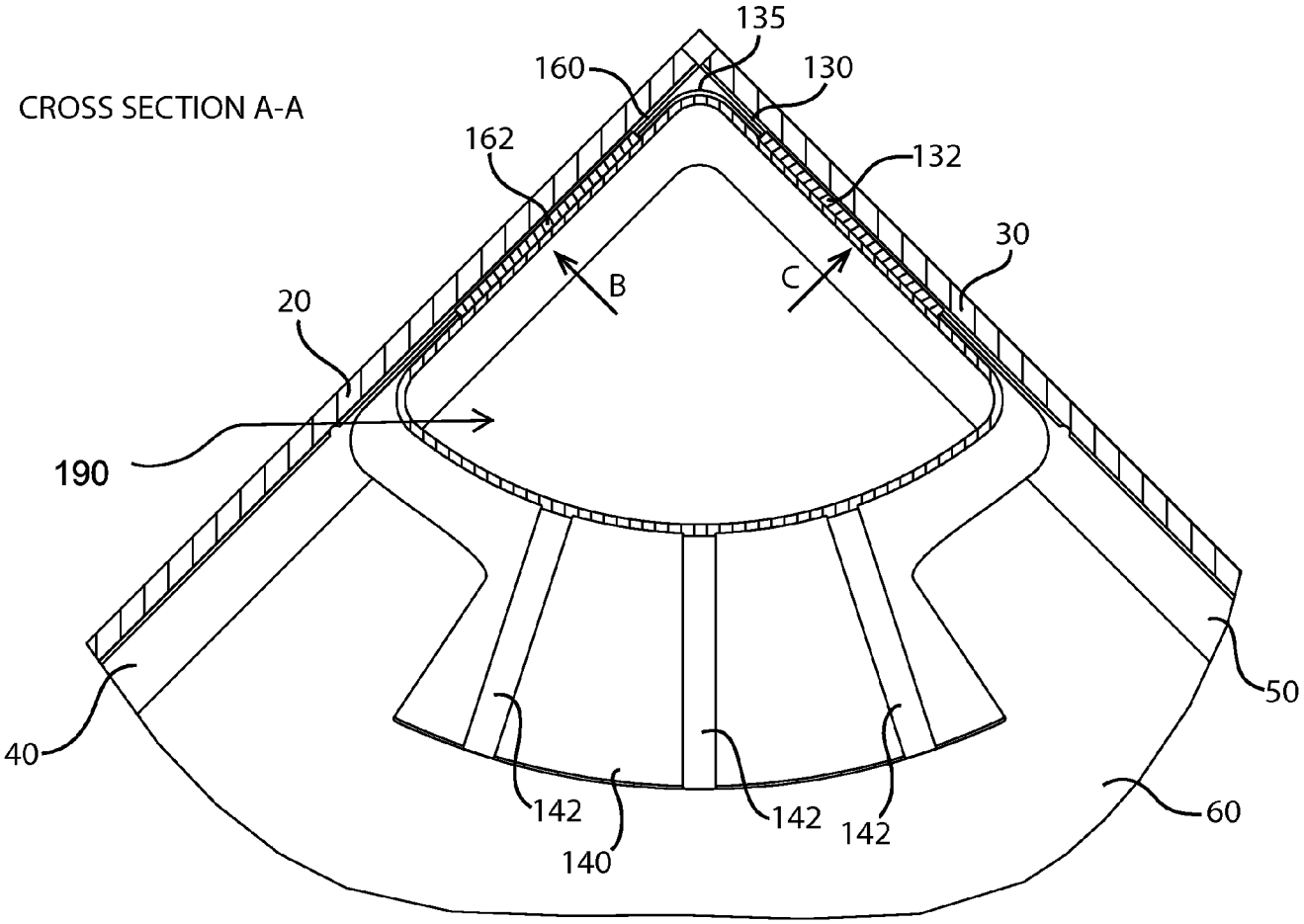
FIG. 8 is a cross-section view A-A as shown in FIG. 7 of a support surface.
Figure 9:
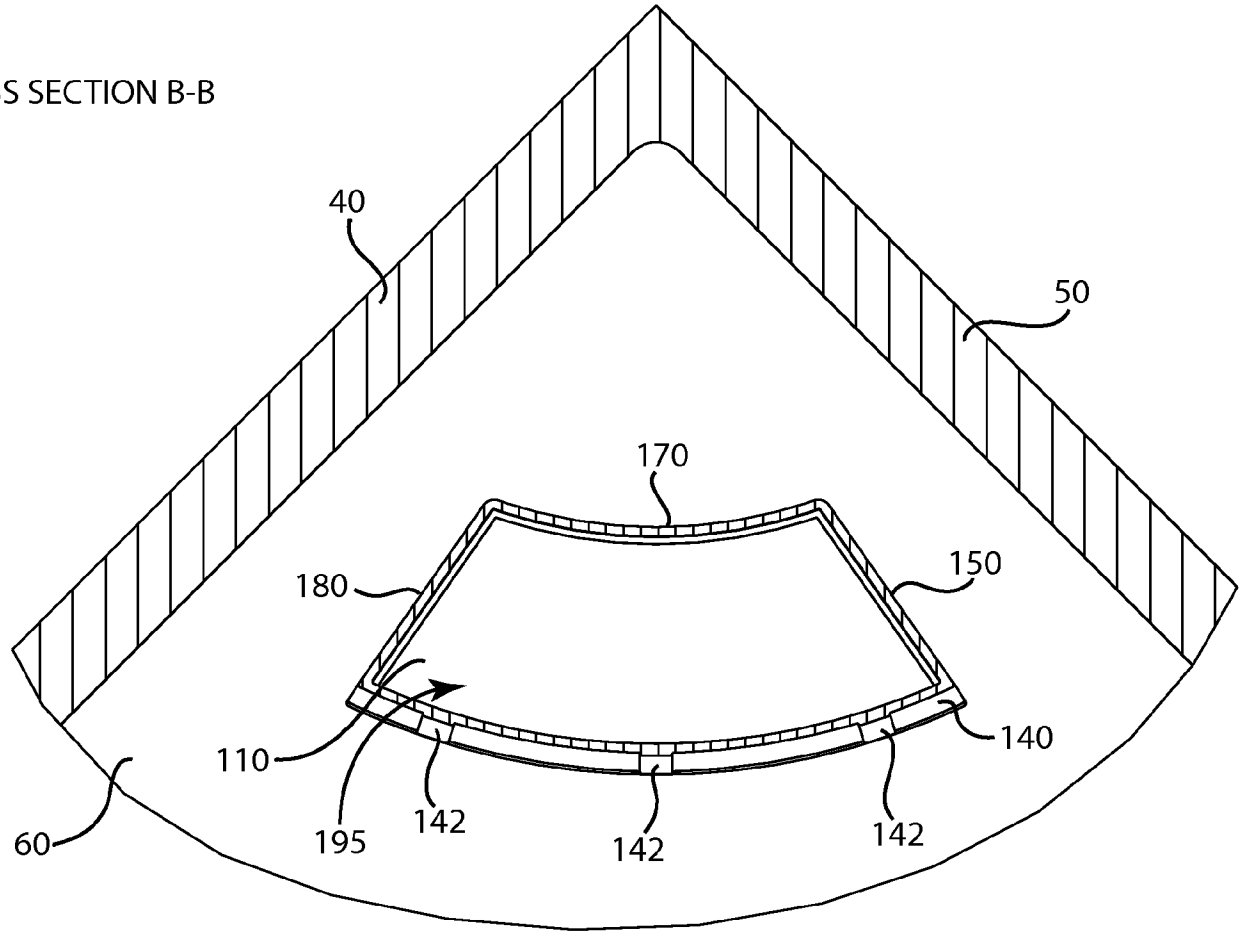
FIG. 9 is a cross-section view B-B as shown in FIG. 7 of a support surface.
Figure 10:
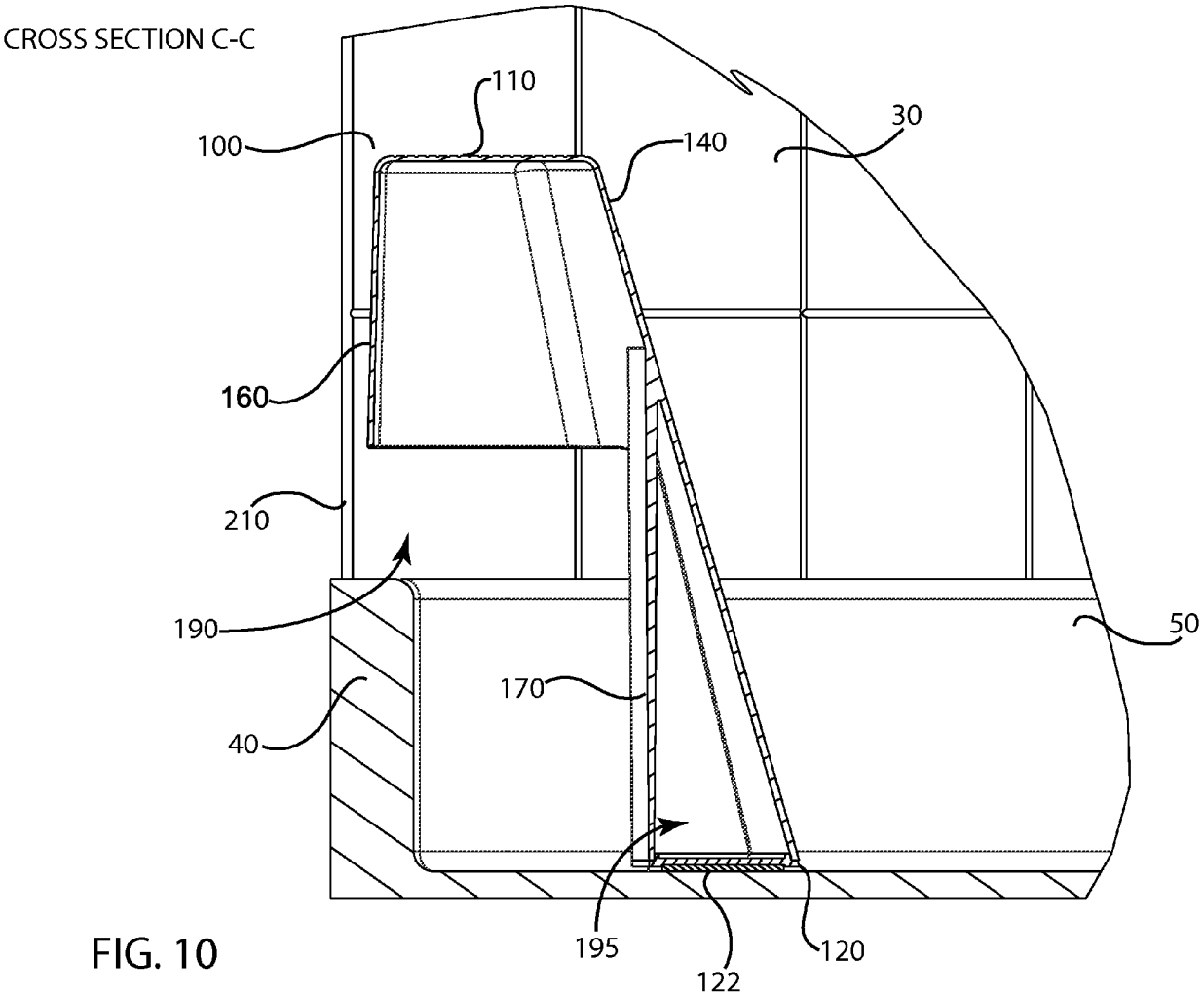
FIG. 10 is a cross-section view C-C as shown in FIG. 3 of a support surface located in a shower.
Figure 11B:
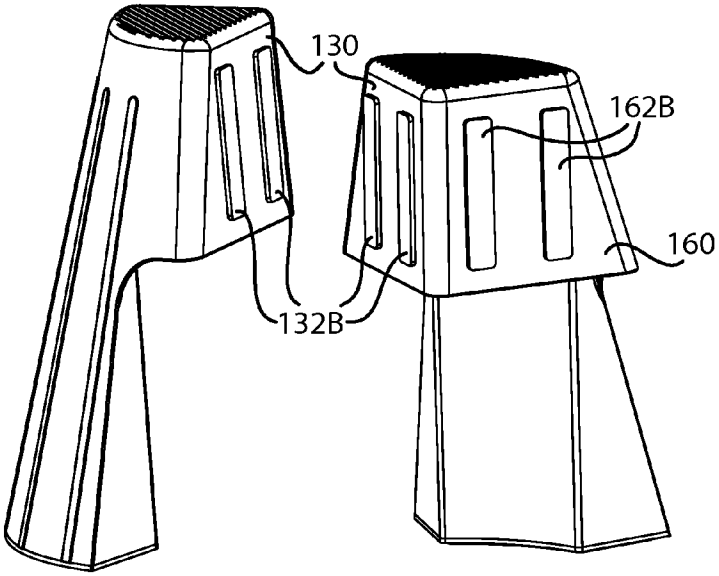
FIGS. 11A-11D are back perspective views of support surfaces showing various friction surfaces.
Figure 11A:
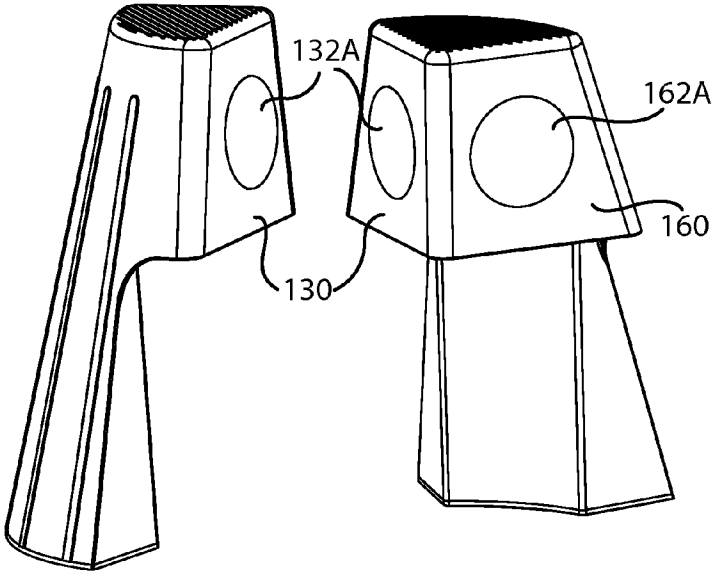
Figure 11D:
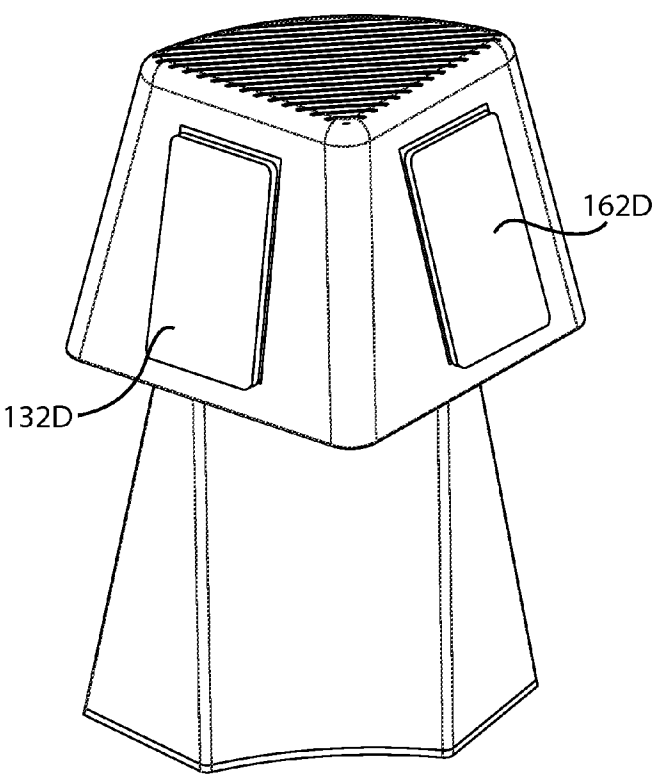
Figure 11C:
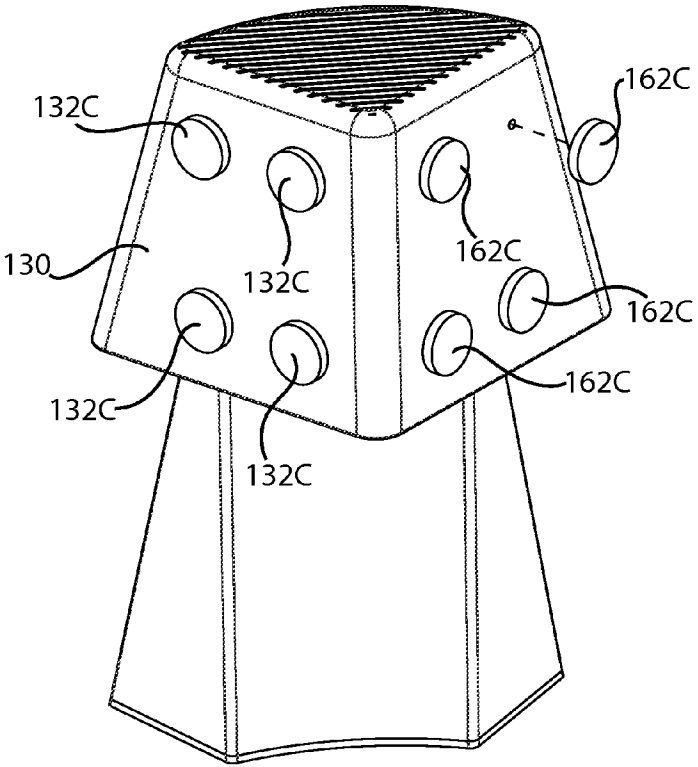

In accordance with various embodiments, as illustrated in the cross section of FIG. 8, as discussed above, the corner support structure 100 may be located in the corner of two walls 20/30 with traction pads 162/132 exerting a force against walls 20/30 along arrows B and C respectively. As illustrated herein, the exterior wall 140, the contact surface 130, and the contact surface 160 form the sides around volume 190 (also shown in FIG. 10). Volume 190 may be formed as a part of a straight tooling pull of the mold that may form the corner support platform 100. In accordance with various embodiments, as illustrated in FIG. 9, the bottom of the support frame and/or the base element is offset (i.e. not in contact with) the base boards 50/40. This cross section also highlights the embodiment in which interior wall 170, exterior wall 140, and side walls 180/150 together form the volume 195 (also shown in FIG. 10). Volume 195 may be formed as part of a straight tooling pull of the mold thus forming a useful device while simplifying manufacturing.

In accordance with various embodiments, the corner support 100 may include a traction pad such as those illustrated in FIGS. 11A-11D. For example, a circular traction pad 132A and circular traction pad 132B, shown in FIG. 11A, may be adhered to the face of the contact surface 130 and the contact surface 160 respectively. In another example, dual strips of traction pad such as traction pads 132B and 162B, shown in FIG. 11B, may be adhered to the face of the contact surface 130 and the contact surface 160 respectively. In another example, a plurality of circular traction pads such as traction pads 132C and 162C, shown in FIG. 11C, may be adhered to the face of the contact surface 130 and the contact surface 160 respectively. In another example, rectangular traction pads such as traction pads 132D and 162D, shown in FIG. 11D, may be adhered to the face of the contact surface 130 and the contact surface 160 respectively. As discussed above and similarly illustrated in FIG. 7, the base member 120 may similarly include a traction pad 122. This traction pad may be similar in shape to those discussed above or as shown in FIG. 7, the traction pad 122 may be formed the same shape as the base member 120 (while not shown traction pads 132/162 may likewise take the shape of their respective surfaces). The traction pads 122, 132, and 162 may cover a substantial area of the contact surfaces 122/130/160, such as more than half of their respective surface area. In other embodiments, the traction pads 122, 132, and 162 may cover very little of the surfaces 120/130/160, such as less than a quarter. Alternatively the pads may also occupy any range in-between.

The traction pads 122/132/162 are located in areas that touch the surrounding support structure, such as the shower walls 30/60 and the shower floor 20. As such, the traction pads 122/132/162 may be specifically selected to limit the ability of the contact surfaces 130/160 to slip relative to the surrounding support structure which they contact such as shower walls 30/60 or shower floor 20. The traction pads may be made from any traction improving material. For example, when used in a wet environment with hard surfaces such as a shower, the traction pads may be formed from a nonslip material such as neoprene rubber, but any material may be used. On other surfaces such as carpet more aggressive traction cleats may be utilized. In accordance with the various embodiments discussed herein, any traction improving surface may be utilized.

The corner support structure as described herein may be formed using plastic materials including, but not limited to, polyethylene (PE), polypropylene (PP), polyvinyl chloride (PVC), acrylonitrile butadiene styrene (ABS), poly carbonate (PC), polyamide (PA), polybutylene terephthalate (PBT), and so on. In various embodiments, the corner support structure may be manufactured using any process including, but not limited to, plastic injection molding, vacuum forming, 3d printing, machining, and so on.

In accordance with one specific example of the corner support structure 100, a base assembly comprises a base mechanically coupled to a base pad. The base pad has the shape of an inner arc mechanically coupled to an outer arc by two lines connecting the inner arc to the outer arc. The base is mechanically coupled to a support frame. The support frame has the shape of a partially rounded front portion mechanically coupled to a side portion. The side portion is mechanically coupled to side pads that can support the support frame against a wall. The side portion and the front portion are mechanically coupled to a top portion. The top portion is mechanically coupled to a foot rest surface. The base is injection molded acrylonitrile butadiene styrene (ABS). The base pad may be a die cut ⅛ inch thick adhesive backed non-slip neoprene rubber. The foot rest surface comprises shallow ribs for non-slip. The side pads may be two die cut ⅛ inch thick adhesive backed non-slip neoprene rubber pads. In accordance with various embodiments, one or more of the elements of the support platform may be injection molded ABS. For example the base member and/or the support frame may be injection molded. While in some embodiments the base pads and side pads may be applied to the support platform structure with an adhesive, in other embodiments, the base pads and side pads may be formed as part of the device during the injection molding process. For example, the base pads and side pads may be insert molded or over-molded into the base member and support frame respectively during the injection molding process.

It should be noted that all directional and/or dimensional references (e.g., upper, lower, upward, downward, left, right, leftward, rightward, top, bottom, above, below, front, back, rear, forward, backward, rearward, inner, outer, inward, outward, vertical, horizontal, clockwise, counterclockwise, length, width, height, depth, and relative orientation) are only used for identification purposes to aid the reader's understanding of the implementations of the disclosed invention(s), and do not create limitations, particularly as to the position, orientation, use, relative size or geometry of the invention(s) unless specifically set forth in the claims.

Connection references (e.g., attached, coupled, connected, joined, and the like) are to be construed broadly and may include intermediate members between a connection of elements and relative movement between elements. As such, connection references do not necessarily infer that two elements are directly connected and in a fixed relation to each other.

We claim:

1. A corner support comprising:

a support platform having a top support surface, with the support platform having two sides that are positioned to contact two perpendicular walls which are each perpendicular to the floor;

a support frame which connects to the top support surface such that the bottom of the support frame and the top support surface are not aligned but are offset from one another such that the area directly below the top support surface is not occupied by the bottom of the support frame, wherein the support frame comprises one or more walls connecting to and extending from each exterior side of a perimeter of a base member, wherein the bottom of the base member is the only contact with the floor and a first wall of the one or more walls is substantially vertical and a second wall which opposes the first wall extends from the base member at an angle up to the top of the support platform.

2. A corner support of claim 1, wherein the support platform extends away from the first wall.

3. A corner support of claim 2, wherein the two sides connect to the second wall.

4. A corner support of claim 1, wherein the two sides, the support platform, and a plurality of the walls of the support frame form a first hollow cavity and the walls of the support frame form a second hollow cavity within the support frame such that the corner support is formable with a straight pull mold.

5. The corner support of claim 1, wherein the two sides include traction pads which are configured to contact the two perpendicular walls respectively and wherein the traction pads are configured to limit the downward movement of the two sides relative to the two perpendicular walls.

6. The corner support of claim 5, wherein a face of at least one of the sides includes a recessed area for receiving one of the traction pads.

7. The corner support of claim 1, wherein the top support surface includes a plurality of recessed grooves.

8. The corner support of claim 7, wherein the plurality of recessed grooves are separated by shallow ribs forming a non-slip surface to support a foot.

9. The corner support of claim 1, further comprising a base member which is connected to the bottom of the support frame and configured to contact a floor.

10. The corner support of claim 9, wherein the base member includes a traction surface that is configured to contact the floor.

11. The leg support of claim 10, wherein the traction surface is defined by a base pad that includes an adhesive backed non-slip neoprene rubber.

12. The corner support of claim 1, wherein the support frame has a convex surface connecting the two sides.

13. The leg support of claim 12, wherein the convex surface is a part of the outer wall.

14. The leg support of claim 1, wherein the base module is injection molded acrylonitrile butadiene styrene.

* * * * *